US007967636B2

(12) United States Patent
Jin et al.

(10) Patent No.: US 7,967,636 B2
(45) Date of Patent: Jun. 28, 2011

(54) ELECTRICAL CONNECTOR WITH TERMINALS STAGGERED FROM EACH OTHER

(75) Inventors: Huo-Xing Jin, Kunshan (CN); Jian-Fei Zhao, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/713,185

(22) Filed: Feb. 26, 2010

(65) Prior Publication Data

US 2011/0092096 A1 Apr. 21, 2011

(30) Foreign Application Priority Data

Oct. 19, 2009 (CN) ..... 2009 1 0308469

(51) Int. Cl.
*H01R 13/648* (2006.01)

(52) U.S. Cl. ..... 439/607.05

(58) Field of Classification Search ..... 439/607.05, 439/607.08, 660
See application file for complete search history.

(56) References Cited

U.S. PATENT DOCUMENTS 6,461,202 B2 * 10/2002 Kline ..... 439/701
6,764,342 B2 * 7/2004 Murayama et al. ..... 439/607.1
6,913,490 B2 * 7/2005 Whiteman et al. ..... 439/607.05
7,059,914 B2 * 6/2006 Tsai ..... 439/660
7,090,540 B2 * 8/2006 Masumoto et al. ..... 439/660
7,270,573 B2 * 9/2007 Houtz ..... 439/607.39
7,422,483 B2 * 9/2008 Avery et al. ..... 439/607.05
7,534,142 B2 * 5/2009 Avery et al. ..... 439/607.05
7,649,146 B2 * 1/2010 Avery et al. ..... 174/262
7,682,192 B2 * 3/2010 Sawdy et al. ..... 439/607.05
7,686,655 B2 * 3/2010 Tsai ..... 439/660
2003/0008560 A1 * 1/2003 Tolmie ..... 439/608
2003/0060083 A1 * 3/2003 Akama et al. ..... 439/608
2004/0242072 A1 * 12/2004 Kumamoto et al. ..... 439/608
2008/0009147 A1 * 1/2008 Avery et al. ..... 439/65

* cited by examiner

*Primary Examiner* — T C Patel
*Assistant Examiner* — Vladimir Imas
(74) *Attorney, Agent, or Firm* — Andrew C. Cheng; Wei Te Chung; Ming Chieh Chang

(57) ABSTRACT

Provided is an electrical connector including an insulative housing defining a plurality of terminal grooves therein and a plurality of terminals received in said terminal grooves. The terminals comprise a plurality of first terminal groups and second terminal groups which are configured as a same structure and alternatively arranged. Each of said first and second terminal groups comprises at least a base portion and an opening portion thereon. The base portion of the first terminal group faces to the opening portion of the neighboring second terminal group, while the opening portion of the first terminal group faces to the base portion of the neighboring second terminal group.

20 Claims, 8 Drawing Sheets

ELECTRICAL CONNECTOR WITH TERMINALS STAGGERED FROM EACH OTHER

BACKGROUND OF THE INVENTION

1. Field of the Invention

The present invention relates to an electrical connector, particularly, to an electrical connector having terminals staggered from each other so as to control the impedance and the inductance in electrical connector.

2. Description of the Related Art

Systems facilitating high-speed data transfer require electrical connectors in which the electrical impedance can be controlled in order to reach the required data transfer rate of the electrical system. It is mandatory that within a high-speed data transfer system, the connector has to be kept with a controlled impedance such that the data transfer rate can be kept within the nominal ranges. The impedance of a connector may be controlled by spacing of the terminals (i.e. exposing partially of the contact terminal into the air), the dimension of the terminals and the thickness within the connector housing.

An improved electrical connector is highly desired to overcome the aforementioned problem.

SUMMARY OF THE INVENTION

Accordingly, an object of the present invention is to provide method and structure for controlling the impedance of an electrical connector.

In order to achieve the object set forth, an electrical connector includes an insulative housing defining a plurality of terminal grooves therein and a plurality of terminals received in said terminal grooves. The terminals comprise a plurality of first terminal groups and second terminal groups which are configured as a same structure and alternatively arranged. Each of said first and second terminal groups comprises at least a base portion and an opening portion thereon. The base portion of the first terminal group faces to the opening portion of the neighboring second terminal group, while the opening portion of the first terminal group faces to the base portion of the neighboring second terminal group.

Other objects, advantages and novel features of the invention will become more apparent from the following detailed description of the present embodiment when taken in conjunction with the accompanying drawings.

DETAILED DESCRIPTION OF THE INVENTION

Figure 1:
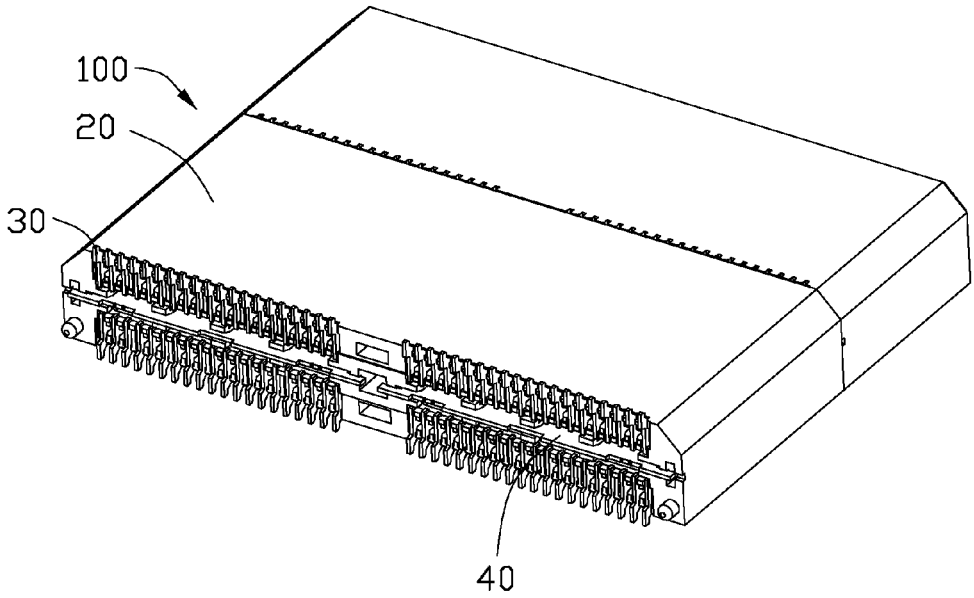
FIG. 1 is a perspective view of an electrical connector made in accordance with the present invention.
Figure 2:
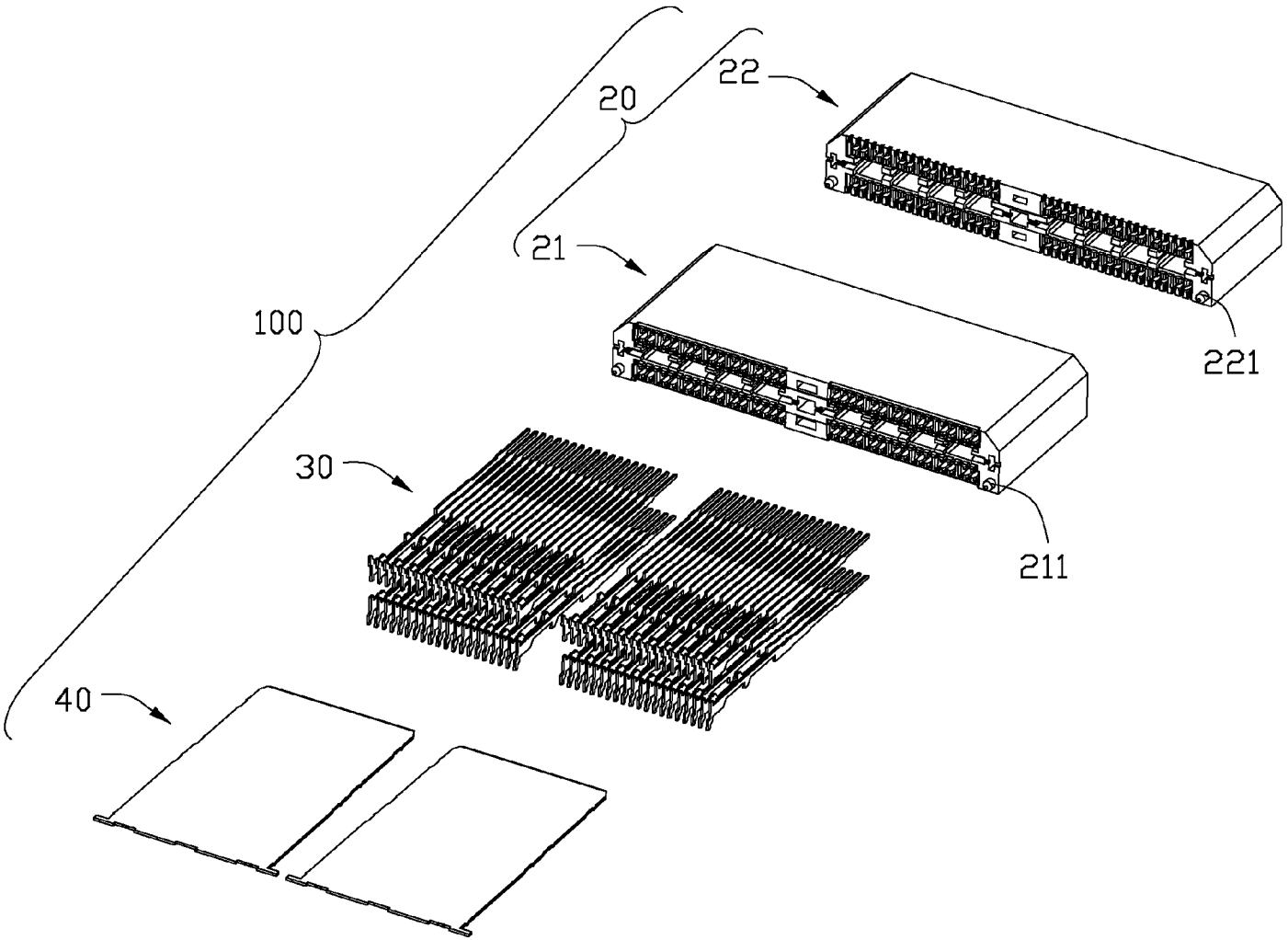
FIG. 2 is an exploded perspective view of the electrical connector shown in FIG. 1.

Reference will now be made to the drawing figures to describe a preferred embodiment of the present invention in detail. Referring to FIGS. 1 and 2, an electrical connector 100 made according to the preferred embodiment of the present invention is disclosed and comprises an insulative housing 20, a plurality of terminals 30 and a pair of metallic plates 40 received in the insulative housing 20.

Figure 3:
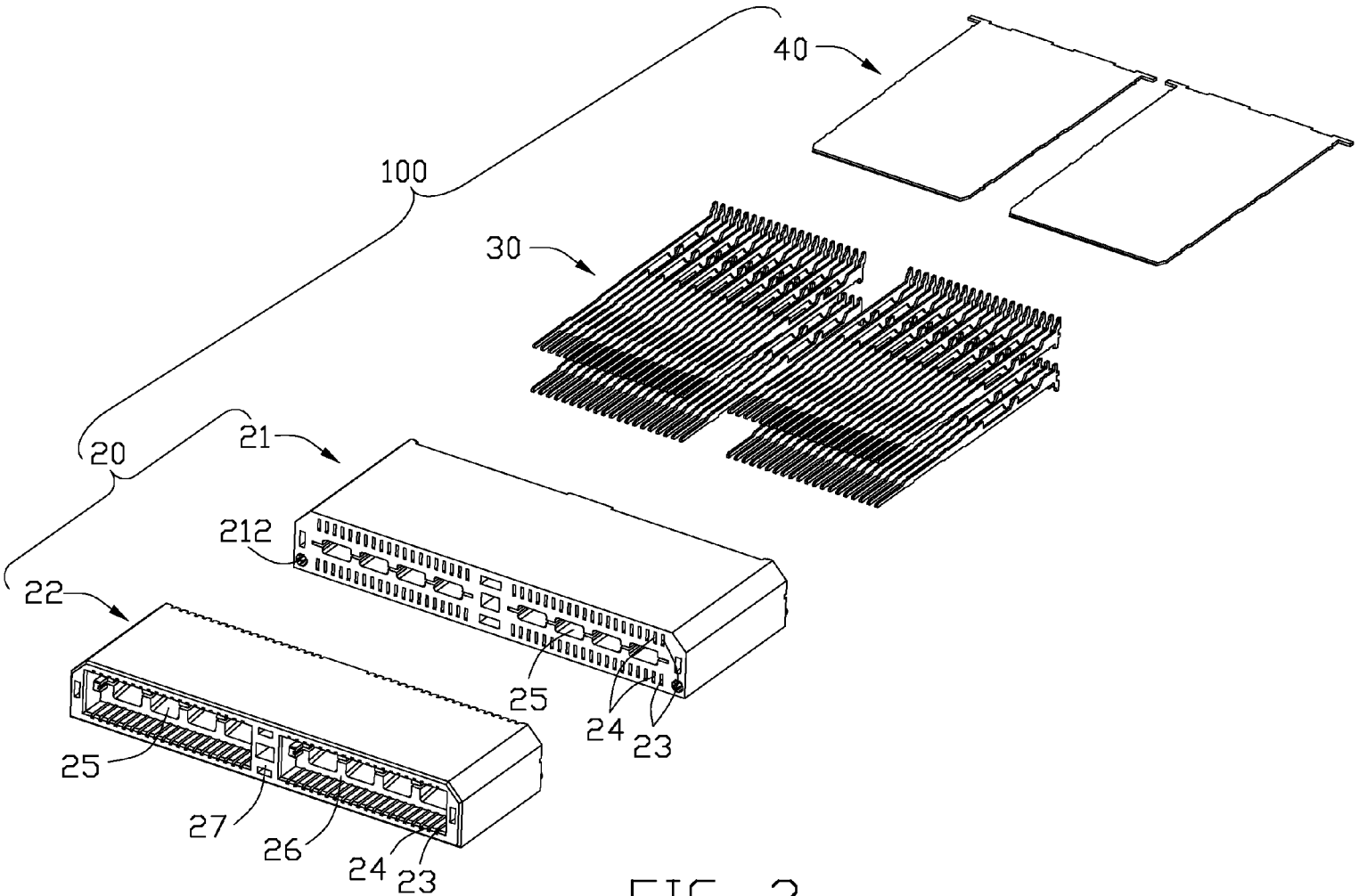
FIG. 3 is another exploded perspective view of the electrical connector shown in FIG. 1.

Referring to FIGS. 2 and 3, the insulative housing 20 comprises a first housing 21 for mounting onto a printed circuit board and a second housing 22 interconnected to the first housing 21. Both of the first and second housings 21, 22 define a plurality of first terminal grooves 23 and second terminal grooves 24 located at opposite sides thereof and running through the first and second housings 21, 22 along a mating direction X. The first and the second terminal grooves 23, 24 are juxtaposed along a transverse direction perpendicular to the mating direction X, therefore every adjacent first terminal grooves 23 are separated by the second terminal groove 24. Both of the first and second housings 21, 22 define a receiving space 25 therein for receiving said metallic plate 40. Each receiving space 25 is divided into two sub-spaces by a partition portion 27. The second housing 22 defines a pair of posts 221 on a rear portion and secured in apertures 212 defined on a front portion of the first housing 21 so as to organize the first and second housings 21, 22 together. A pair of posts 211 are also formed on a rear portion of the first housing 21 for securing the electrical connector 100 on the printed circuit board. A pair of tongue plates 26 are formed in the front portion of the second housing 22 for cooperating with a complementary mating connector (not shown).

Figure 4:
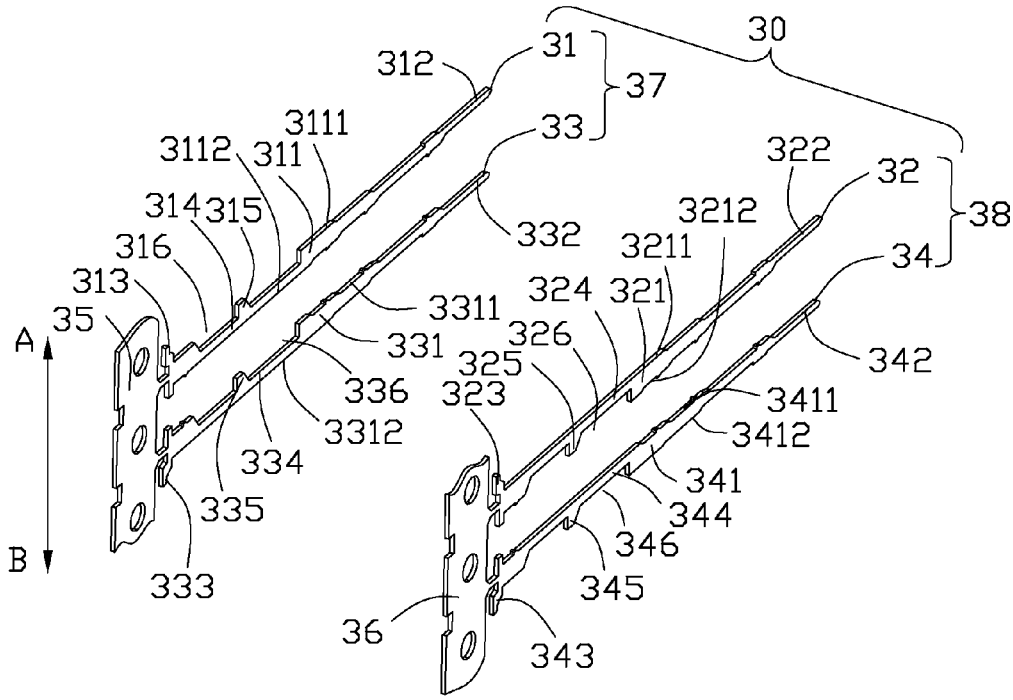
FIG. 4 is a perspective view of terminals of the electrical connector shown in FIG. 1.

Referring to FIGS. 2 and 4, the terminals 30 are arranged into two rows and respectively received in the terminals grooves 23, 24. The terminals 30 in the first row comprise first terminals 31 and second terminals 32 alternatively arranged, and the terminals 30 in the second row comprise third terminals 33 and fourth terminals 34 alternatively arranged. When the terminals 30 are manufactured, the first terminals 31 and the third terminals 33 are connected to a same first tie 35, the second terminals 32 and the fourth terminals 34 are connected to a same second tie 36. The structure of the first terminal 31 is same as the structure of the fourth terminal 34, and the structure of the second terminal 32 is same as the structure of the third terminal 33. The first, second, third and fourth terminals 31, 32, 33, 34 respectively comprise a first, second, third and fourth body portions 311, 321, 331, 341, a first, second, third and fourth contacting portions 312, 322, 332, 342 extending from the body portion, and a first, second, third and fourth solder portions 313, 323, 333, 343 extending out of the second housing 20.

The first, second, third and fourth body portions 311, 321, 331, 341 respectively define a first edge 3111, 3211, 3311, 3411 facing a first direction A and a second edge 3112, 3212, 3312, 3412 facing a second direction B which is opposite to the first direction A. The first, second, third and fourth body portions 311, 321, 331, 341 respectively define a first, second, third and fourth base sections 314, 324, 334, 344 and a first, second, third and fourth opening sections 315, 325, 335, 345. The base sections 314, 324, 334, 344 are respectively formed in continuous configurations. The first and third base sections 314, 334 are respectively formed on the second edges 3112, 3312 of the first and third body portions 311, 331, while the first and third opening sections 315,335 are respectively formed on the first edges 3111, 3311 of the first and third body portions 311, 331. The second and fourth base sections 324, 344 are respectively formed on the first edges 3211, 3411 of the second and fourth body portions 321, 341, while the second and fourth opening sections 325, 345 are respectively formed on the second edges 3212, 3412 of the second and fourth body portions 321, 341. The first, second, third and fourth opening sections 315, 325, 335, 345 respectively define a first, second, third and fourth openings 316, 326, 336, 346.

The first opening 316 on the first terminal 31 is distant away from the first base section 314 and opened toward the first direction A, while the second opening 326 on the second terminal 32 is distant away from the second base section 324 and opened toward the second direction B, therefore the first opening 316 and the second opening 326 are arranged in an offset manner. The first terminal 31 and second terminal 32 are arranged in a same row in the electrical connector 100, therefore the first opening 316 of the first terminal 31 faces to the second base section 324 of the second terminal 32, and the second opening 326 of the second terminal 32 faces to the first base section 314 of the first terminal 31, which will reduce the dimension of the opposite faces of the first terminal 31 and second terminal 32. The impedance and the inductance in electrical connector is controlled by changing the dimension of the opposite faces between adjacent terminals, therefore the structure of the first and second terminals in the present invention is preferable to reduce the impedance and the inductance of the electrical connector.

Referring to FIG. 4, the third and fourth terminals are alternatively arranged in the other row of the electrical connector 100. The third opening 336 of the third terminal 33 is spaced away from the third base section 334 and opened toward the first direction A, while the fourth opening 346 of the fourth terminal 34 is spaced away from the fourth base section 344 and opened toward the second direction B, that is to say, the third and fourth openings 336, 346 of the third and fourth terminals 33, 34 are arranged in an offset manner, therefore the dimension of the opposite face between the third and fourth terminals can be reduced due to the special terminal arrangement.

The first terminal 31, the third terminal 33 together with the first tie 35 form a first terminal group 37, while the second terminal 32, the fourth terminal 34 together with the second tie 36 form a second terminal group 38. In fact, the first terminal group 37 is same as the second terminal group 38, the second terminal group 38 can turn around 180 degrees to form the first terminal group 37, therefore the first terminal group 37 and the second terminal group 38 can be made by a same die, which is advantageous for reducing the manufacturing cost.

Referring to FIG. 2, the metallic plates 40 are inserted into the receiving space 25 and separate the first and second rows of terminals 30 from each other so as to reduce the crosstalk occurred therebetween.

Figure 5:
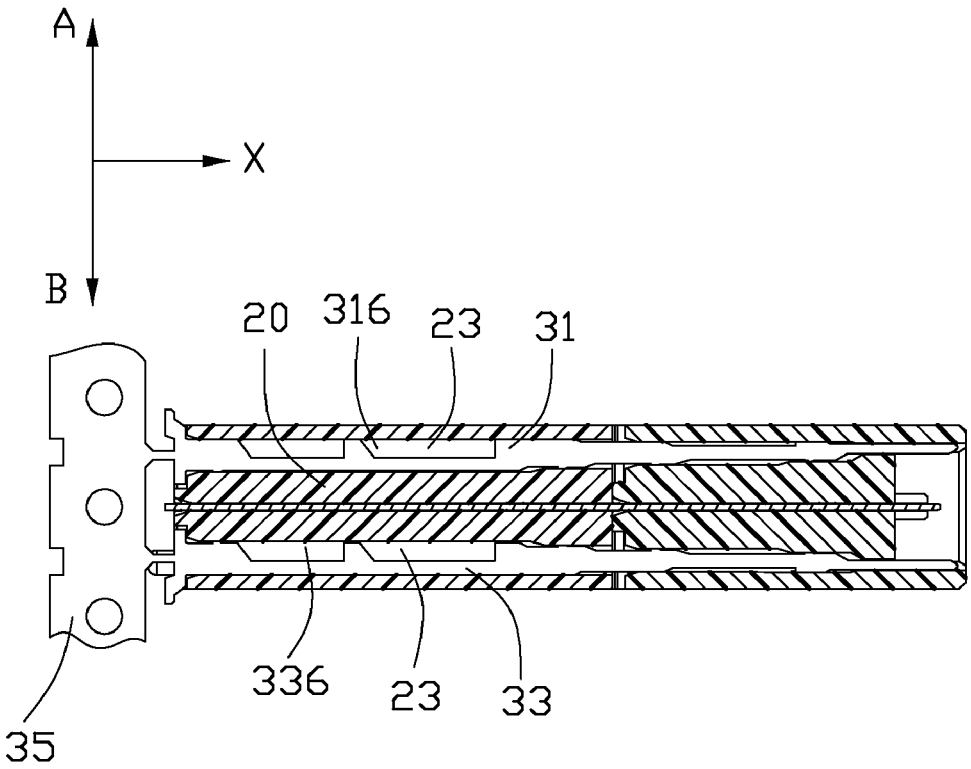
FIG. 5 is a cut-away view of the electrical connector shown in FIG. 1, which shows a first terminal and a third terminal mounted in an insulative housing of the electrical connector.
Figure 6:
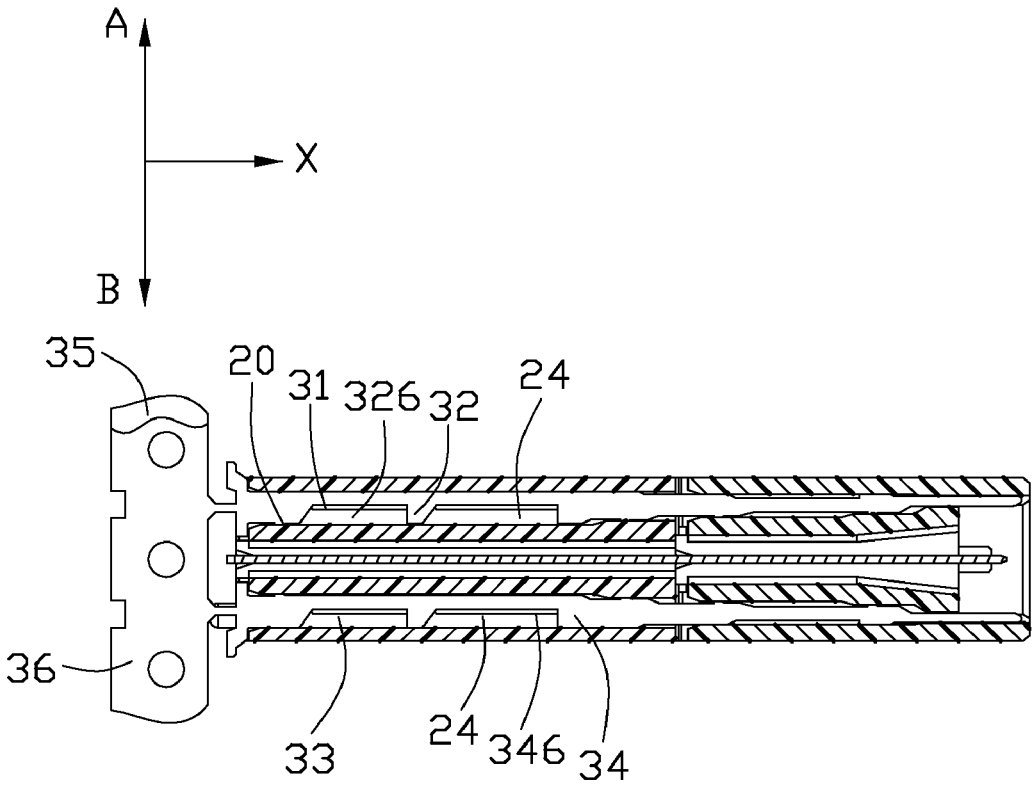
FIG. 6 is a cut-away view of the electrical connector shown in FIG. 1, which shows a second terminal and a fourth terminal mounted in the insulative housing of the electrical connector.

Referring to FIGS. 2, 5, 6, the electrical connector 100 is assembled by a following method: firstly, providing an insulative housing 20 and a plurality of first terminal groups 37 and second terminal groups 38; then, inserting the first terminal groups 37 into the first terminal grooves 23 along the mating direction X and making sure the first and third openings 316, 336 facing toward the first direction A; and then, inserting the second terminal groups 38 into the second terminal groove 24 along the mating direction X and making sure the second and fourth openings 326, 346 facing toward the second direction B; further, cutting off the first and second carriers 35, 36; finally, inserting the metallic plates 40 into the receiving space 25. The total assembling process is simple and advantageous for reducing the manufacturing cost.

Figure 7:
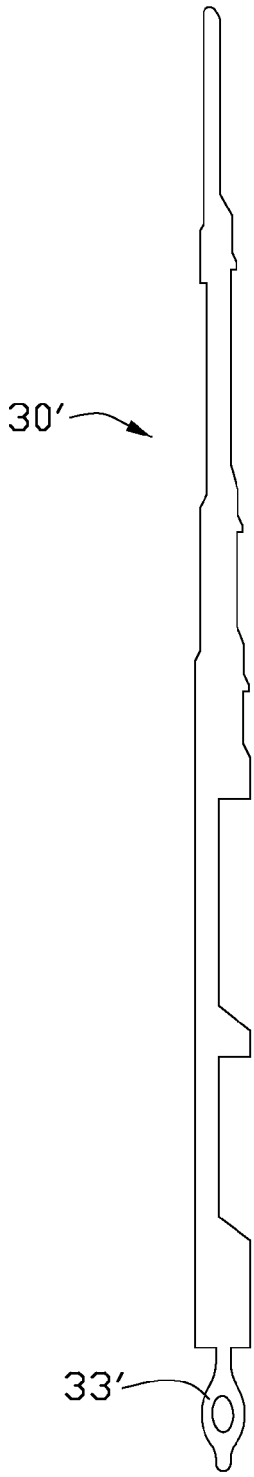
FIG. 7 is a side view of a second embodiment of the terminals of the electrical connector shown in FIG. 1.

FIG. 7 shows a second embodiment of the terminals 30' of the present invention. The basic structure of the terminal 30' is same as the first terminal 31 and the only modification is the solder tail 33'. The solder tail 33' is designed as a symmetrical type which is suitable for providing dual mounting surfaces, therefore the neighboring terminals can be arranged as a terminal 30' in a normal type closer to a terminal 30' in a reversal type. In this embodiment, all of the terminals 30' can be made in a same configuration, which sufficiently reduces the manufacturing cost.

Figure 8:
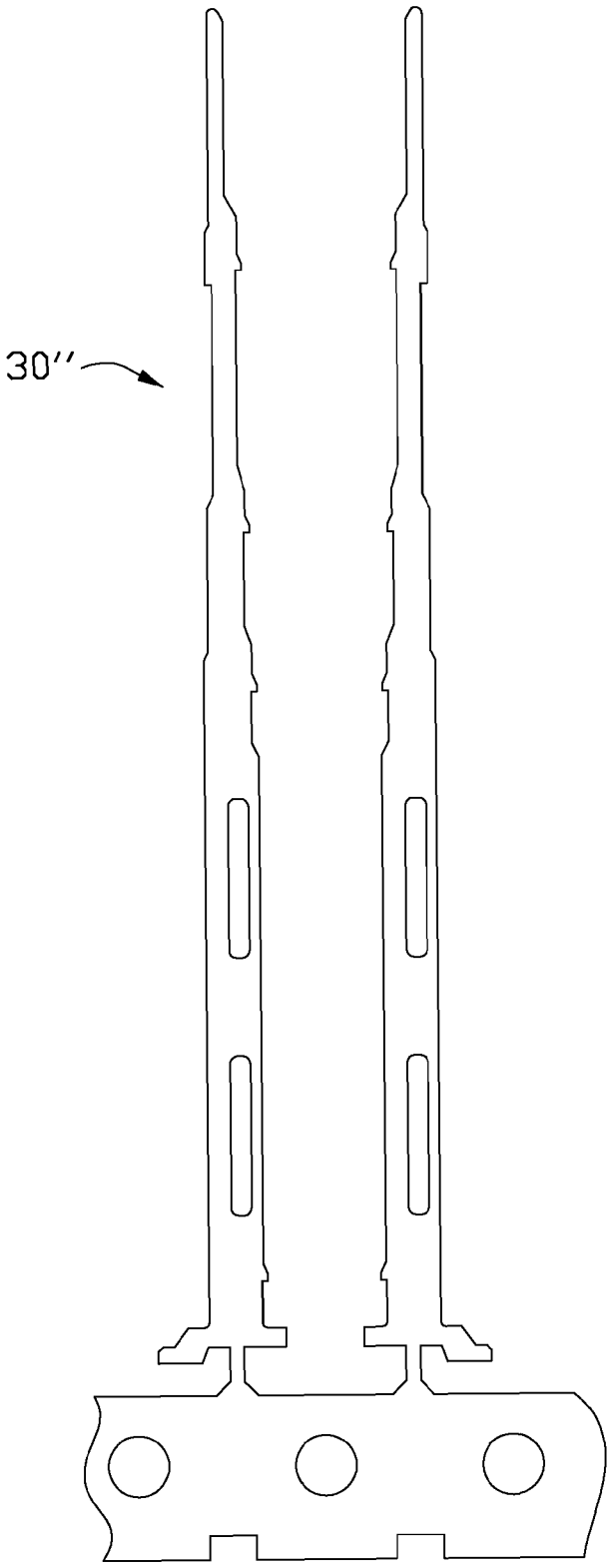
FIG. 8 is a side view of a third embodiment of the terminals of the electrical connector shown in FIG. 1.

FIG. 8 shows a third embodiment of the terminals 30", the openings 313" are configured as an elongated slot and enclosed within the terminals 30", which is different from the open sided openings 313 in the first embodiment. Other characteristics of the terminal 30" is same as the terminal 30 in the first embodiment, therefore, detailed description will be omitted hereby.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of terminal grooves therein; and a plurality of terminals received in said terminal grooves, and each of the terminals having same structure and including a base portion and an opening portion thereon; the terminals divided into a plurality of first terminal groups and second terminal groups which are configured as a same structure and alternately arranged, and each of said first and second terminal groups respectively comprising two terminals aligning with each other along a up-to-down direction;

wherein the two terminals of the second terminal group are disposed in upside down manner with respect to the two terminals of the first terminal group;

wherein the base portions of the first terminal group face to the opening portions of the neighboring second terminal group, while the opening portions of the first terminal group face to the base portions of the neighboring second terminal group.

2. The electrical connector as described in claim 1, wherein the opening portions are open sided slots, and the slots of the first and second terminal groups respectively face toward opposite directions.

3. The electrical connector as described in claim 1, wherein the opening portions are enclosed within the corresponding base portions.

4. The electrical connector as described in claim 1, wherein each of the first and second terminal groups comprises a solder tail adapted for providing dual mounting surfaces.

5. The electrical connector as described in claim 1, wherein a metallic plate is provided and received in the insulative housing, and the two terminals of the first terminal group includes a first and a third terminals arranged at an opposite side of the metallic plate, while the two terminals of the second terminal group includes a second and a fourth terminals arranged at an opposite side of the metallic plate.

6. The electrical connector as described in claim 5, wherein the insulative housing comprising a first housing and a second housing interconnected together along a mating direction.

7. A method of turning the impedance of an electrical connector, comprising:

providing an electrical connector defining a plurality of terminal grooves therein;

providing a plurality of terminals with same contour, each comprising a body portion and an opening portion at one side thereof;

disposing one terminal in an imagery vertical plane and inserting the one terminal into the terminal groove with the opening portion facing a first direction;

disposing another terminal in another imagery vertical plane and inserting the another terminal into the another terminal groove, with the one terminal disposed adjacent to the another terminal, with the opening portion of the another terminal facing a second direction opposite to the first direction.

8. The method as described in claim 7, wherein said terminal grooves are arranged into two opposite rows and a metallic plate is inserted therebetween.

9. The method as described in claim 7, wherein the body portions of the neighboring terminals are arranged in an offset manner.

10. The method as described in claim 7, wherein the opening portions of the terminals are configured as open sided slots.

11. An electrical connector comprising:

an insulative housing defining at least one row of first passageways;

a plurality of first terminals arranged in one corresponding row and positioned in the corresponding first passageways, respectively, each of said first terminals defining a front contact section, and a rear base section; wherein each of the rear base section of the first terminal defines an opening to adjust impedance under condition that the openings of the rear base sections of the first terminals are arranged in a zigzag manner along a first direction defined by said row; wherein said opening is formed in the rear base section of the corresponding first terminal and essentially extends through the rear base section in a thickness direction thereof, which is same with the first direction.

12. The electrical connector as claimed in claim 11, wherein said passageways are aligned with one another in said first direction.

13. The electrical connector as claimed in claim 12, wherein said housing further defines a plurality of second passageways along another row parallel to said row, and a plurality of second terminals are disposed in the corresponding second passageways, respectively, under said terminals are similar to the first terminals each including the front contacting section and the rear base section.

14. The electrical connector as claimed in claim 13, wherein the housing defines a center line between said two rows, and the openings of the base sections of the first terminals and those of the second terminals are oriented in a same second direction perpendicular to said first direction, while the contacting sections of the first terminals and those of the second terminals are arranged in a mirror image manner with each other with regard to the center line.

15. The electrical connector as claimed in claim 14, wherein the housing defines a groove along the center line to receive a shielding plate for electrically segregating the base sections of the first terminals and those of the second terminals.

16. The electrical connector as claimed in claim 15, wherein said groove defines a plurality of enlarged spaces at intervals.

17. The electrical connector as claimed in claim 16, wherein said housing comprises front and rear parts, each part including the first passageways, the second passageways and the groove under condition the front part receives the contacting sections and the rear part receives the base sections.

18. The electrical connector as claimed in claim 17, wherein the enlarged spaces of the groove in the front part are tapered.

19. The electrical connector as claimed in claim 18, wherein the front part defines a pair of supports on two interior surfaces to sandwich two side edges of a front portion of the shielding plate while exposing the remainders of the front portion of the shielding plate.

20. The electrical connector as described in claim 1, wherein the terminals are disposed in different imagery vertical geometry planes along the up-to-down direction.

* * * * *